United States Patent [19]

Gooray et al.

[11] Patent Number: 4,750,018

[45] Date of Patent: Jun. 7, 1988

[54] PRE-TRANSFER COPY SHEET CLEANING APPARATUS

[75] Inventors: Arthur M. Gooray, Penfield; Dennis A. Abramsohn, Pittsford; Stephen M. Borostyan, Victor; Joseph Mammino, Penfield, all of N.Y.

[73] Assignee: Xerox Corporation, Stamford, Conn.

[21] Appl. No.: 67,577

[22] Filed: Jun. 26, 1987

[51] Int. Cl.[4] ..... G03G 15/00

[52] U.S. Cl. ..... 355/14 SH; 355/3 SH; 355/3 R; 355/14 R

[58] Field of Search ..... 355/3 SH, 14 SH, 3 R, 355/15, 3 BE, 16

[56] References Cited

U.S. PATENT DOCUMENTS

| | | | |
|---|---|---|---|
| 3,912,257 | 10/1975 | Gibbons | 271/174 |
| 4,001,838 | 1/1977 | Maddox | 346/153 |
| 4,370,050 | 1/1983 | Matsui et al. | 355/3 |
| 4,478,510 | 10/1984 | Fujii et al. | 355/15 |
| 4,515,466 | 5/1985 | Heisler | 355/15 |
| 4,657,598 | 4/1987 | Green | 355/15 |

FOREIGN PATENT DOCUMENTS 59-30556 2/1984 Japan .

*Primary Examiner*—A. C. Prescott

*Attorney, Agent, or Firm*—William A. Henry, II

[57] ABSTRACT

A copier/printer having a transfer station for transferring images from an imaging member to copy sheets includes the improvement of removing debris from the surfaces of copy sheets facing the imaging member before the copy sheets reach the transfer station. At least a pair of cooperating rolls are positioned to form a nip for driving the copy sheets therebetween toward the transfer station. The cooperating rolls include a drive roll and a dielectric roll with the dielectric roll being electrostatically charged by the drive roll and paper through contact and separation during the inter-copy gaps between copy sheets in transit to the transfer station through contact with the copy sheets to electrostatically attract debris from the copy sheets.

15 Claims, 2 Drawing Sheets

PRE-TRANSFER COPY SHEET CLEANING APPARATUS

This invention relates to an electrostatic copying apparatus, and more particularly to a device for cleaning fibers, dust, lint, etc., from the surface of copy sheets in the copying apparatus prior to transfer and also to clean drive rolls.

Electrostatic copying machines in most instances supply copy sheets of paper from a paper feed source to a transfer area for transfer of toner image to the copy sheets. During transport to the transfer area, paper particles and similar dust particles are produced by the frictional contact of the surface of the copy sheets with the peripheries of feed rollers at the feeding source and also by the frictional contact of the surfaces of the paper with the peripheries of transport rollers provided in the path of transport of the paper or with the surfaces of transport guides.

Dust on the surface of copy sheets is attracted to the surface of photoconductors employed in electrostatic copiers when the toner saturated images on the photoconductors are transferred in the transfer area to the copy sheets. This dust is cleaned by a cleaning unit within a copier, however, when the cleaning unit employs a blade which has a forward edge that presses against the photoconductor's outer surface, dust particles tend to agglomerate at the forward edge portion of the blade member and raise the forward edge of the blade member by the agglomerated dust particles, possibly holding the blade member locally out of proper pressing contact with the photoconductive surface. This has a negative impact on the residual toner removing function of the blade cleaning unit. And since the toner is reclaimed to be used again, dust particles reclaimed with the toner lowers the quality of the toner and in turn the quality of the developed and transferred image. Also, dust gets attracted to drive rolls in the copier, thus reducing the friction coefficient.

Contamination due to paper debris results in failure of components, copy quality degradation and blade cleaner failure, as well as drive roll loss of friction. Therefore, many attempts have been made to reduce or eliminate this contamination. For example, U.S. Pat. No. 3,912,257 to Gibbons teaches a method of removing a flexible sheet from transport devices by applying a varying electrical field between the sheet and an electric conductor. The conductor is coated with a dielectric material making electrostatic detacking possible. U.S. Pat. No. 4,001,838 to Maddox teaches a method of cleaning sheets in an electrostatic printing apparatus by lightly wetting roller surfaces before the printing station, and thereby lightly wetting the sheets. This method causes debris particles to be attracted to the roller from the sheet. U.S. Pat. No. 4,370,050 to Matsu et al. is directed to a method of pre-transfer cleaning a sheet in an electrostatic copying apparatus. After a sheet is withdrawn from a cassette by a first pair of rollers, it is advanced through a second pair of cooperating rollers employed to advance individual sheets to an image transfer station. One of the second rollers has a dielectric coating and the other second roller is made of rubber. A cleaning pad, made of an elastic material such as polyurethane, engages the dielectric roller to remove dusts and to triboelectrically charge the peripheral face of the roller. The pad is retractable and cleaned with a brush. Japanese Pat. No. 59-30556 to Makiyama discloses a method for removing dusts from a sheet using electrostatic force and a dust attractive member positioned in front of a sheet feed source. The sheet is electrostatically charged by frictional contact with a first set of rollers then is passed through the dust attractive member without making contact. Charged fibers and dust are attracted to this member and thereby removed from the sheet. Even though some of these methods of removing dust particles and debris from copy sheets are somewhat successful, a need is still shown for a simple and economical copy sheet debris removal method and apparatus.

Accordingly, a number of improved on-line devices and configurations are disclosed for electrostatically removing loose debris from copy sheets. In one aspect of the present invention, a drive roll is employed to charge a dielectric roll during intercopy gap periods between copy sheets. Also, the idler material is such that cleaning also occurs when contact is made with feed paper. In another embodiment, a conductive idler roll is coated with a layer of dielectric material and biased to produce an electric cleaning field that removes or attracts debris from copy sheets. Also, in an aspect of the invention, a small roll of appropriate material, for example, isoprene, is placed in contact with the dielectric roll to triboelectrically charge an idler roll of an appropriate material, for example, acrylic. Loose fibers from copy sheets are attracted to the charged roll. In yet another embodiment of the present invention, a cleaning brush is made of highly conductive material such as metal or carbon filled fibers and biased so that the brush charges a dielectric roll that attracts copy sheet debris.

The above-mentioned features and others of the invention, together with the manner of obtaining them, will best be understood by making reference to the following specification in conjunction with the accompanying drawings, wherein.

DETAILED DESCRIPTION OF THE PREFERRED EMBODIMENT

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
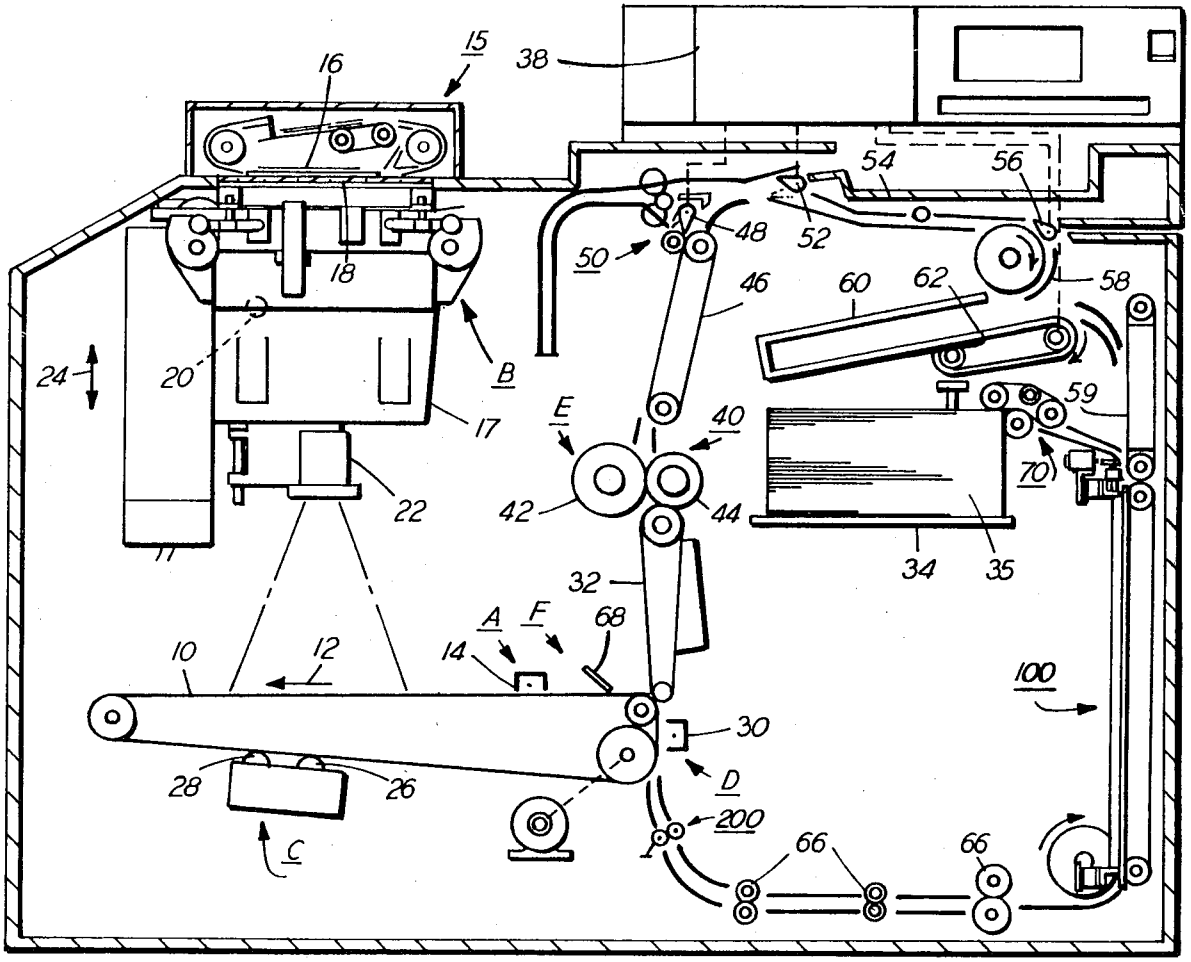
FIG. 1 is a schematic elevational view showing an electrophotographic copier employing the features of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the copy sheet debris removal device of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit indicated generally by the reference numeral 15, positions original document 16 face-down over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding ray in seriatim, to platen 18. The document handling unit recirculates documents back to the stack supported on the tray. Preferably, the document handling unit is adapted to serially sequentially feed to documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a copying or printing machine which does not include a document handling unit, or when one is making copies of A3 or 11"×17" documents where the document handler has to be raised up from the platen and the oversized document manually placed on the platen for copying.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image past copy sheet debris removal device 200 of the present invention and on to transfer station D. At transfer station D, a copy sheet is moved into contact with the toner powder image. Transfer station D includes a corona generating device 30 which sprays ions onto the backside of the copy sheet. This attracts the toner image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face-up orientation so that the imaged side which has been transferred and fused is face up. If inverter path 50 is selected, the opposite is true, i.e., the last printed face is face-down. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 face-down. They are stacked in duplex tray 60 on top of one another in the order in which they are copied.

In order to complete duplex copying, the previously simplexed sheets in tray 60 are fed to conveyor 59 seriatim by bottom feeder 62 back to transfer station D for transfer of the toner powder image to the opposide side of the sheet. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual toner particles remain adhering to belt 10. These residual particles are removed from the photoconductive surface thereof at cleaning station F. Cleaning station F includes a blade 68 in contact with the photoconductive surface of belt 10. These particles are cleaned from the photoconductive surface of belt 10 by the rotation of belt 10 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2:
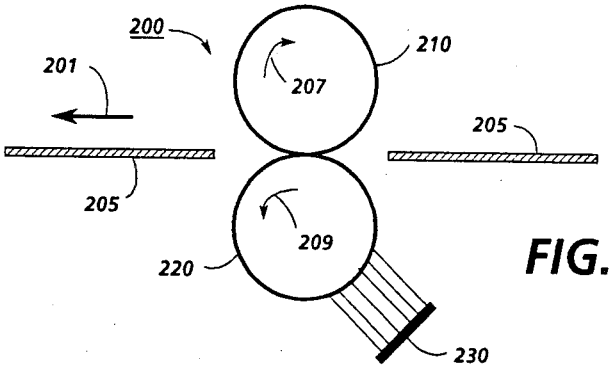
FIG. 2 is an enlarged partial side view of the debris removal device of FIG. 1.
Figure 3:
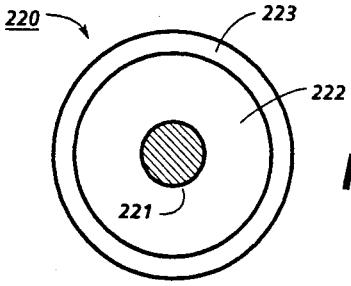
FIG. 3 is an enlarged partial side view of a dielectric roll employed in the debris removal device shown in FIG. 1.

Turning now to an aspect of the present invention, a copy sheet debris removal device 200 adapted to electrostatically remove loose fibers, dust, talc, etc., from the surface of copy sheets 35. As shown in FIGS. 1 and 2, copy sheets 35 in route to transfer area D pass through electrostatic debris remover 200 that comprises a pair of transport rolls 210 and 220 that cooperate to propel copy sheets that pass through a nip formed therebetween toward transfer means 30. Transport roll 210 rotates clockwise in the direction of arrow 207 and roll 220 rotates in the direction of arrow 209 or counter clockwise. Copy sheets enter the nip formed between rolls 210 and 220 in the direction of arrow 201 or right to left as viewed in FIG. 2. The copy sheets are supported for transport on sheet guides 205. The sides of copy sheets 35 closest to photoconductive belt 10 have debris thereon removed by dielectric roll 220. Also, the non-image side fibers are removed by the drive roll and then cleaned off the drive roll by the acrylic idler during the intercopy gap between sheets. Drive roll 210 charges dielectric roll 220 by triboelectrification through contact and separation during the intercopy gap between sheets by as much as about 5 kV. The level is maintained when the dielectric roll is in contact with the copy sheets, since charging also occurs. As a result, loose debris (fibers, dust, talc, etc.) are transferred to drive roll 210 and to dielectric roll 220 due to the electric field between the roll and the copy sheet at the nip. Once on the roll, the fibers are cleaned by stationary brush 230. It should be understood that brush 230 could be a foam pad or blade and could be a rotating brush with a flicker bar adapted to flick the debris from the surface of the a brush. As an alternative for charging dielectric roll 220, brush 230 could be made of highly conductive material such as metal or carbon filled fiber and biased so that it brush charges the dielectric idler roll. Dielectric roll 220 shown in FIG. 3 has a shaft 221 that supports a bearing material 222 such as an acetal on which is mounted dielectric material 223 such as fluorocarbon, polycarbonate, polyurethane, acrylic, epoxies, etc.. The dielectric roll can be made of a single material such as Teflon TM or consist of a dielectric or conductive material coated with a layer 3 microns to 5 mm of a selected material chosen for dielectric or triboelectric properties. Typical materials can be selected from those listed in *Modern Plastics Encyclopedia,* Vol. 61, No. 10A, page 2, Oct. 1984, in addition to rubber including butyl, polyisoprene, neoprene, etc..

The coating materials may be used alone or in blends, alloys and mixtures and be combined with organic and inorganic fillers, extenders, pigments, colorants, reinforcements, antioxidants, antistatics, coupling agents, flame retardants, fungicides, preservatives, heat stabilizers, lubricants, plasticizers, processing aids, tribo charge control agents and the like to modify and obtain special properties.

The coatings may be ranked into a triboelectric series such as that by J. Henniker following the procedure described in NATURE, page 196, (Nov. 3, 1962).

Figure 4:
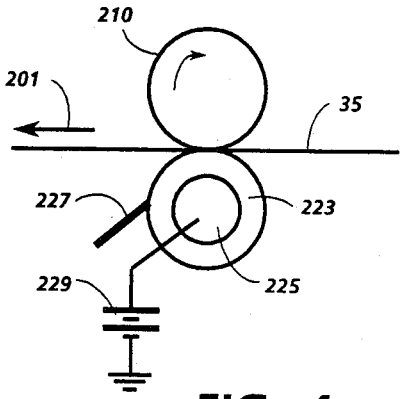
FIG. 4 is an enlarged partial side view of an alternative embodiment of a debris removal device in accordance with an aspect of the present invention employing a biased dielectric roll.
Figure 5:
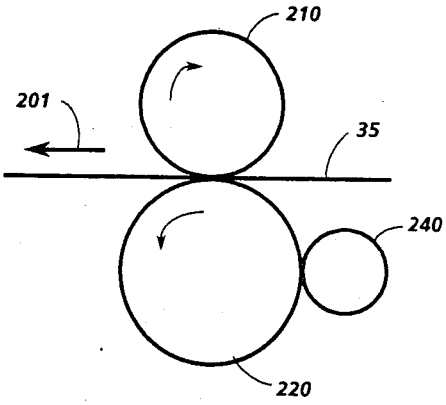
FIG. 5 is an enlarged partial side view of another alternative embodiment of a debris removal device of the present invention that includes a charging roll.

In FIG. 4, an alternative embodiment of the present invention is shown that includes a drive roll 210 made of rubber such as isoprene that cooperates with idler roll 226 to drive copy sheet 35 in the direction of arrow 201 which is toward transfer area or station D. Conductive idler roll 226 comprises a dielectric coating 223 on the surface of a metal support 225. The metal support is biased to produce the cleaning electric field which removes paper debris. Blade 227 is used to remove debris from the dielectric roll. Typically, roll 226 is biased through metal member 225 positively or negatively by an energy source 229 to about 1.5 kV. Another embodiment of the present invention includes a small roll of appropriate material in FIG. 5 being placed in contact with idler dielectric roll 220 to triboelectrically charge the idler roll in order to attract debris to the dielectric roll away from copy sheet 35. If the idler roll is acrylic, Delrin TM, Tedlar TM, Teflon TM or other similar material, the small roll can be made of isoprene.

It should now be understood that an apparatus adapted to remove debris from copy sheets has been disclosed that can be applied to rolls already in machines which scuff up extra paper debris as they come in contact with paper or a separate full width device adapted to remove debris from one or both sides of paper being fed into a machine. The apparatus also cleans drive rolls in the machine in order to maintain friction between the drive rolls. A dielectric roll is charged by a specially designed brush, roll or through its interaction with a drive roll or paper with which it forms a nip that copy sheets to be cleaned pass through. In the use of the inter copy sheet gap to initially charge the dielectric roll by a drive roll and charging with paper, a brush is employed to clean the dielectric roll of collected debris. The dielectric idler roll also serves the purpose of preventing paper fiber contamination of the contacting drive roll. In addition, debris lodged on the drive roll from the top-side of the sheet being cleaned will be cleaned by the charged dielectric idler roll due to the same electrostatic principles involved in cleaning the sheet. This is important toward maintaining proper friction and drive force at the drive nip, maintaining proper tribo properties for charging the dielectric material, and for controlling paper fiber contamination.

What is claimed is:

1. In a copier/printer having a transfer station for transferring images from an imaging member to copy sheets, the improvement of removing debris from the surfaces of the copy sheets in particular facing the imaging member before the copy sheets reach the transfer station, characterized by:

at least a pair of cooperating rolls positioned to form a nip for driving the copy sheets therebetween toward the transfer station, said at least a pair of cooperating rolls includes a drive roll and a dielectric roll with the dielectric roll being initially electrostatically charged by said drive roll through triboelectrification during the intercopy gaps between copy sheets in transit with the charging level being maintained by the copy sheets and positioned to electrostatically attract debris from the copy sheets.

2. The improvement of claim 1, including means for cleaning the copy sheet contacting surface of said dielectric roll.

3. The improvement of claim 2, wherein said means for cleaning said dielectric roll is a brush.

4. The improvement of claim 3, wherein said dielectric roll comprises an acetal polymer mounted on a shaft with a covering dielectric layer taken from a group consisting of acrylic, fluorocarbon, polyurethane, epoxy, etc..

5. The improvement of claim 4, wherein said drive roll is made of rubber.

6. The improvement of claim 5, wherein said rubber drive roll is selected from a group consisting of butyl, polyisoprene, neoprene, etc..

7. In a printer apparatus having a transfer station for transferring images from an imaging member to copy sheets, the improvement of removing debris from the surfaces of the copy sheets facing the imaging member before the copy sheets reach the transfer station, characterized by:

at least a pair of cooperating rolls positioned to form a nip for driving the copy sheets therebetween toward the transfer station, said at least a pair of cooperating rolls includes a drive roll and a metal roll having a dielectric coating with the dielectric coating being charged by an energy source which biases said metal roll, and means for cleaning the copy sheet contacting surface of said dielectric coating.

8. In a copier/printer having a transfer station for transferring images from an imaging member to copy sheets, the improvement of removing debris from the surfaces of the copy sheets facing the imaging member before the copy sheets reach the transfer station in order to prevent toner contamination, characterized by:

at least a pair of cooperating rolls positioned to form a nip for driving the copy sheets therebetween toward the transfer station, said at least a pair of cooperating rolls includes a drive roll and a dielectric roll, and charging means in the form of a small roll adapted to contact and charge said dielectric roll such that debris will be electrostatically attracted to the dielectric roll from the copy sheets.

9. The improvement of claim 8, wherein said dielectric roll comprises an acetal polymer mounted on a shaft with a covering dielectric layer taken from a group consisting of acrylic, fluorocarbon, polyurethane, epoxy, etc.

10. The improvement of claim 9, wherein said drive roll is made of rubber.

11. The improvement of claim 10, wherein said rubber drive roll is made from a group consisting of butyl, polyisoprene, neoprene, etc.

12. The improvement of claim 8, wherein charging of said dielectric roll is by contact and separation in said nip.

13. The improvement of claim 12, wherein slip is denuminus between said cooperating rolls.

14. The improvement in claim 1, wherein charging of said dielectric roll is accompished through contact and separation with said drive roll and through contact with and separation from copy sheets.

15. In a copier/printer having a transfer station for transferring images from an imaging member to copy sheets, the improvement of removing debris from the surfaces of the copy sheets in particular facing the imaging member before the copy sheets reach the transfer station, characterized by:

at least a pair of cooperating rolls positioned to form a nip for driving the copy sheets therebetween toward the transfer station, said at least a pair of cooperating rolls includes a drive roll and a dielectric roll with the dielectric roll being charged by said drive roll through contact and separation during the intercopy gaps between copy sheets in transit with the charging level being maintained by the copy sheets and positioned to electrostatically attract debris from the copy sheets.

* * * * *